US007628662B2

(12) United States Patent
Demastus

(10) Patent No.: US 7,628,662 B2
(45) Date of Patent: Dec. 8, 2009

(54) MOTORIZED PUSH POLE DEVICE

(76) Inventor: Dwayne Demastus, 837 Center La., Clermont, FL (US) 34711

( * ) Notice: Subject to any disclaimer, the term of this patent is extended or adjusted under 35 U.S.C. 154(b) by 4 days.

(21) Appl. No.: 12/057,434

(22) Filed: Mar. 28, 2008

(65) Prior Publication Data

US 2009/0247027 A1 Oct. 1, 2009

(51) Int. Cl.
*B63H 19/00* (2006.01)

(52) U.S. Cl. ..... 440/36; 114/221 R

(58) Field of Classification Search ..... 114/221 R; 440/21, 36

See application file for complete search history.

(56) References Cited

U.S. PATENT DOCUMENTS 2,787,795 A * 4/1957 Snodgrass ..... 440/36
2,991,750 A * 7/1961 Letourneau ..... 440/36
6,168,480 B1 * 1/2001 Schaller ..... 440/36
6,220,197 B1 * 4/2001 Pohlman ..... 440/36
2007/0202756 A1 * 8/2007 Hardwick ..... 440/21

* cited by examiner

*Primary Examiner*—Lars A Olson
(74) *Attorney, Agent, or Firm*—McKinney Law, PLLC

(57) ABSTRACT

A motorized push pole device having a standard mounted to a raised poling platform on a boat. A housing is mounted to the standard wherein the housing is adapted to removably clamp around a push pole. A drive wheel is mounted under the housing, wherein a periphery of the drive wheel is in contact with the push pole and adapted to rotate in a first direction causing push pole to move in an extendable motion and the drive wheel adapted to rotate in an opposing second direction causing push pole to move in a retractable motion. An electrical switch is connected to a motor for controlling operation of the motor for rotating the drive wheel. The motor includes a rotating motor shaft terminating in a worm gear. The drive wheel further comprising a cog wheel for engaging the worm gear of the motor.

14 Claims, 3 Drawing Sheets

MOTORIZED PUSH POLE DEVICE

BACKGROUND OF THE INVENTION

1. Field of the Invention

The present invention relates generally to boats, and more specifically to a novel apparatus to assist a fisherman using a push pole to propel a boat across the surface of a water body.

2. Description of the Prior Art

One of the best ways to approach and catch fish on shallow water flats is to use a push pole. The push pole is used to propel the boat quietly from the transom of the boat using manual labor. The length of the pole is generally around twenty feet but can vary depending on the depth of water, the user's personal preference, and the boat setup, among other things. In use, the fisherman stands on an elevated platform at the transom of the boat and inserts the lower end of the pole into the water until the foot of the pole contacts the bottom. The fisherman firmly grasps an upper portion of the pole as the foot of the pole remains stationary and the fisherman uses the pole to push away from the bottom causing the boat to thrust forward. The user's hands slide up the pole as the boat moves forward. This process is repeated continuously to move the boat across the water. Accordingly, it takes a significant amount of energy and becomes tiresome to the fisherman.

There have been attempts to improve push poles to reduce the amount of energy expended by a fisherman. By way of example, note U.S. Patent Application Publication No. 2007/0202756 to Hardwick that discloses a power push pole that includes a drive wheel. The drive wheel is at the lower end of the pole and is operated by a switch on the handle of the pole so that the drive wheel can be turned off and on. The fisherman lowers the drive wheel in the water until it is resting on the bottom. An electrical motor attached to the drive wheel is switched on causing the drive wheel to rotate and propel the boat forward. A shortcoming of this prior art is that the motor is in the water causing vibrations that will scare fish away. Another shortcoming is that the device cannot be used with any pole but requires a specially made pole. Accordingly, what is needed in the art is a push pole device that assists a fisherman in poling a boat that can be used with any existing pole and easily adapted for use with a boat.

It is, therefore, to the effective resolution of the aforementioned problems and shortcomings of the prior art that the present invention is directed.

However, in view of the prior art at the time the present invention was made, it was not obvious to those of ordinary skill in the pertinent art how the identified needs could be fulfilled.

SUMMARY OF THE INVENTION

This invention is a motorized push pole device comprising a standard mounted to a raised poling platform on a boat. A housing is mounted to the standard wherein the housing is adapted to removably clamp around a push pole. A drive wheel is mounted under the housing, wherein a periphery of the drive wheel is in contact with the push pole and adapted to rotate in a first direction causing push pole to move in an extendable motion and the drive wheel adapted to rotate in an opposing second direction causing push pole to move in a retractable motion. An electrical switch is connected to a motor for controlling operation of the motor for rotating the drive wheel. The motor includes a rotating motor shaft terminating in a worm gear. The drive wheel further comprising a cog wheel for engaging the worm gear of the motor.

It is therefore a primary object of the invention to provide a motorized push pole device that improves the ability of a fisherman to pole a boat for long periods of time without fatigue.

Another object of the present invention to provide a motorized push pole device that can be easily retrofitted for use with any standard push pole and of any length.

These and other important objects, advantages, and features of the invention will become clear as this description proceeds.

The present invention, accordingly, comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
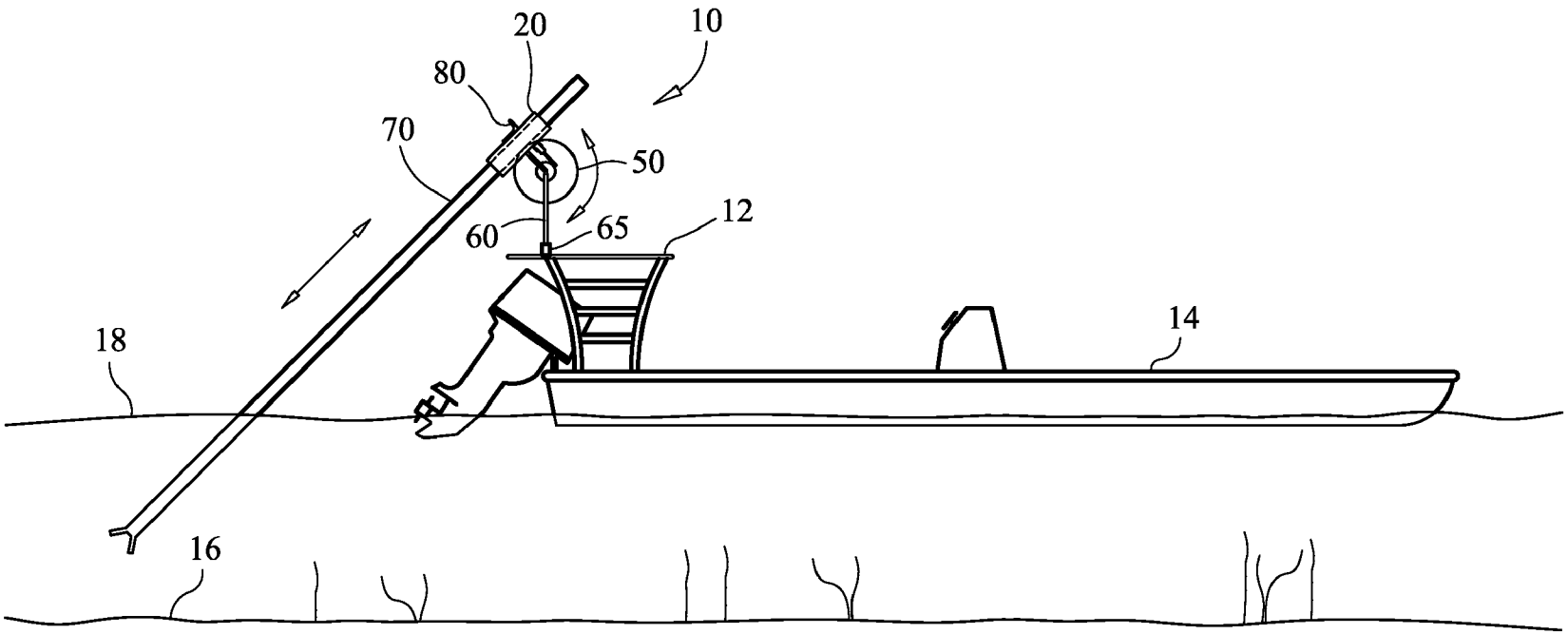
FIG. 1 is a perspective view showing an embodiment of the present invention.

FIG. 1 shows the motorized push pole device 10 mounted to poling platform 12 of boat 14. Boat 14 is floating on water surface 18, which typically is a few feet above bottom 16 when the present device is used for poling boat 14. Housing 20 is clamped around push pole 70. Drive wheel 50 is mounted to standard 60, wherein drive wheel 50 rotates in a first direction and causes push pole 70 to move in the extended direction. When the direction of drive wheel 50 is reversed, push pole 70 moves up in a retracted position. The periphery of drive wheel 50 is comprised of a rubber material to provide traction to drive wheel 50 as it rotates and contacts push pole 70. Electric switch 85 located on handle 80 operates electric motor 30 that drives drive wheel 50 and controls the direction of rotations. In the preferred embodiment, switch 85 is in electrical communication with electric motor 30 by conventional wiring (not shown). The power supply for motorized push pole device 10 is provided by a 12, 24 or 36-volt, direct current (DC) power supply such as a battery. In alternative embodiments, switch 85 can control motor 30 using a wireless transmitter, receiver and controller.

Figure 3:
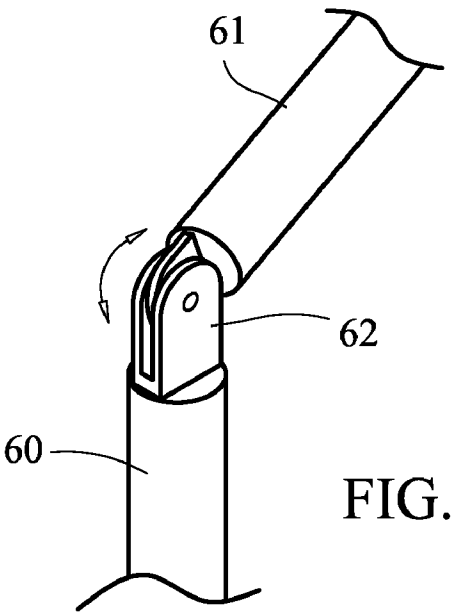
FIG. 3 is a perspective view showing an adjustable joint of an embodiment of the present invention.
Figure 2:
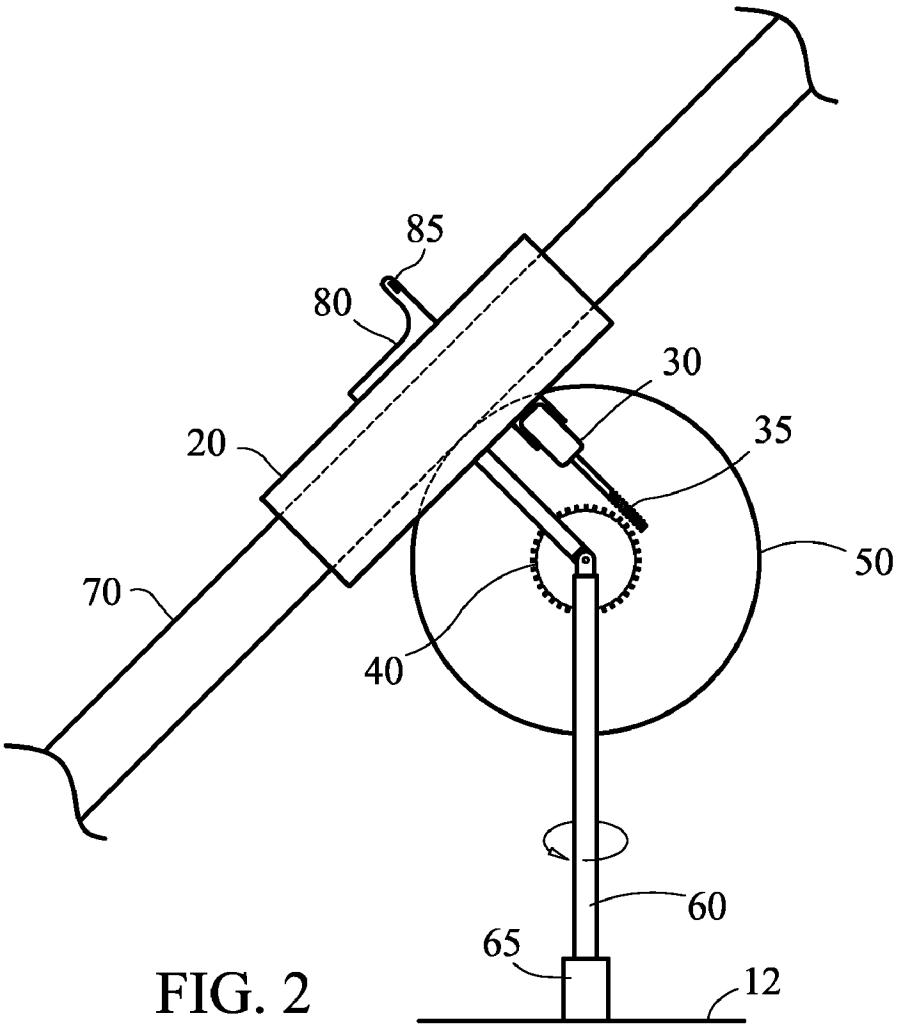
FIG. 2 is side view showing the drive wheel and motor of an embodiment of the present invention.

Referring now to FIG. 2, a partial side view of the motorized push pole device 10 is shown. The housing for electric motor 30, worm gear 35 and cog wheel 40 is not shown for clarity. Standard 60 slides within mounting base 65, which is secured to platform 12 of boat 14. This allows standard 60 to rotate in a horizontal plane along with device 10. Once device 10 is located in the desired location in the horizontal plane, housing 20, which is clamped around push pole 70, can be rotated in the vertical plane to be in the desired angle to bottom 16 using joint 62 and upper portion 61 as illustrated in FIG. 3.

Figure 4:
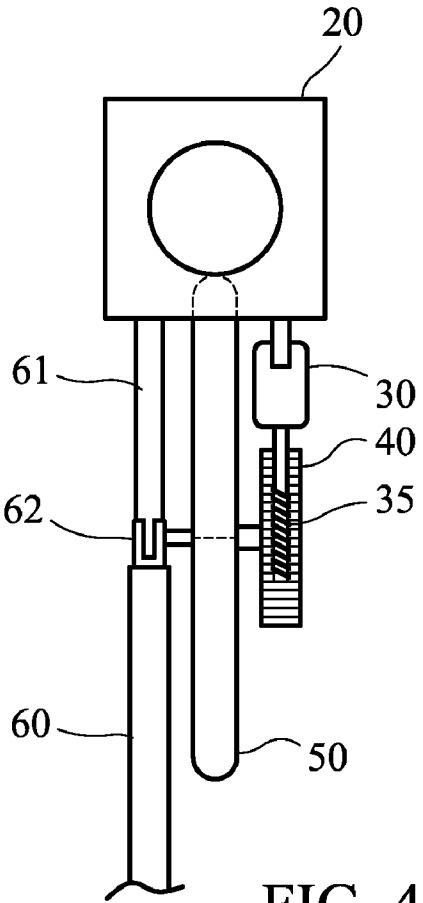
FIG. 4 is a partial top view showing an embodiment of the present invention.

As shown in FIG. 4, an edge of drive wheel 50 contacts the outer surface of push pole 70. As drive wheel 50 rotates, friction force between drive wheel 50 and push pole 70 causes push pole 70 to move in the direction drive wheel 50 is rotating. Electric motor 30 turns worm gear 35 in either a clockwise or counterclockwise rotational direction. Worm gear 35 causes drive wheel 50 to rotate in a first direction to extend push pole 70 further away from boat 14 to propel boat 14 forward. Motor housing 32 covers motor 30, worm gear 35 and drive wheel 50 to protect from the environment and the user from being injured by the moving parts of device 10. As worm gear 35 turns in a second opposing direction, drive wheel 50 is rotated in a second direction that retracts push pole 70 from the water. Standard 60 includes joint 62 that allows housing 20 that is clamped to push pole 70 to be adjusted the angle of push pole 70 with respect to the bottom as the user is poling boat 12 in the desired direction. Although, a worm gear and cog wheel arrangement is shown to rotate drive wheel 50, any type of mechanical arrangement to rotate drive wheel 50 is contemplated by the present invention (e.g., rack and pinion gear).

Figure 5:
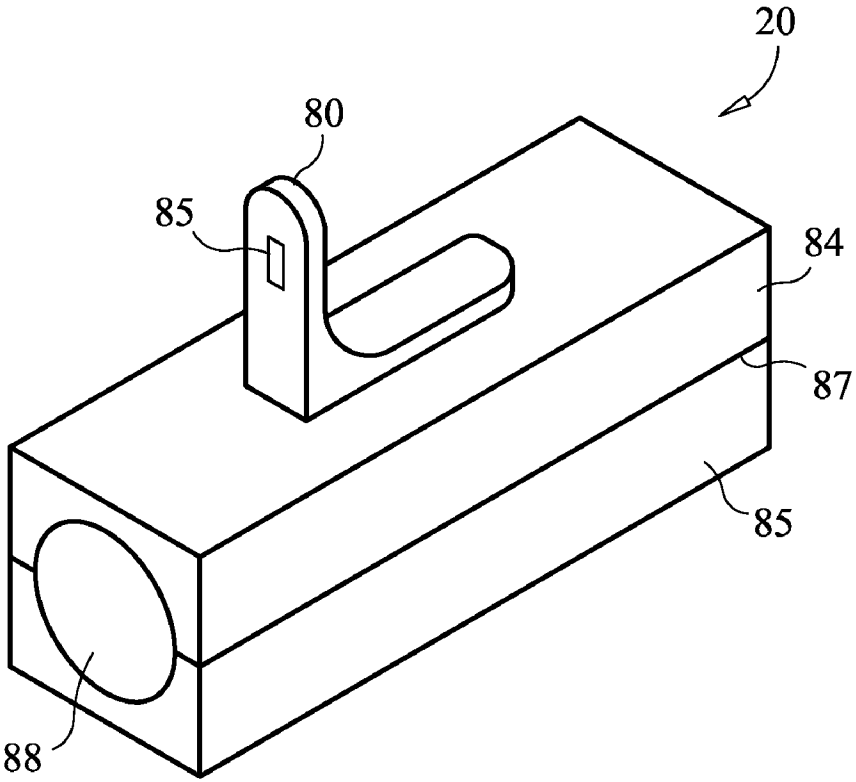
FIG. 5 is a perspective view of the housing of an embodiment of the present invention.

Referring now to FIG. 5, shows a perspective view of housing 20, which clamps around push pole 70. Electric switch 85 is located on handle 80 to allow a user to toggle between extending or retracting push pole 70. Housing 20 includes two halves 84, 85 that are hingedly connected about longitudinal edge 87. In operation, housing 20 is rotated open about longitudinal edge 87 and push pole 70 is placed within housing 20. Aperture 88 is located on each opposing end of housing 20 and adapted so that push pole 70 slides through housing 20.

The particular embodiments disclosed above and in the drawings are illustrative only, as the invention may be modified and practiced in different but equivalent manners apparent to those skilled in the art having the benefit of the teachings herein. Furthermore, no limitations are intended to the details of construction or design herein shown. It is therefore evident that the particular embodiments disclosed above may be altered or modified and all such variations are considered within the scope and spirit of the invention.

It is also to be understood that the following claims are intended to cover all of the generic and specific features of the invention herein described, and all statements of the scope of the invention, which as a matter of language, might be said to fall there between.

Now that the invention has been described,

What is claimed is:

1. A motorized push pole device comprising:

a standard removably secured to a raised poling platform on a boat;

a housing mounted to the standard and adapted to removably clamp around a push pole;

a drive wheel mounted to the standard, wherein drive wheel adapted to rotate in a first direction causing push pole to move in an extendable motion and the drive wheel adapted to rotate in an opposing second direction causing push pole to move in a retractable motion;

an electrical switch connected to a motor for controlling operation of the motor for rotating the drive wheel;

an electric power supply for providing electric power to the motor, wherein the motor further comprising a rotating motor shaft terminating in a worm gear and the drive wheel further comprising a cog wheel for engaging the worm gear of the motor; and a mounting base for receiving a first end of the standard so that the standard rotates in a horizontal plane.

2. The motorized push pole device of claim 1, further comprising an adjustable joint so that the housing rotates in a vertical plane to a desired angle.

3. The motorized push pole device of claim 2, wherein the housing comprising a first half and a second half hingedly connected about a longitudinal edge and having a first aperture disposed on a first end of the housing and a second aperture disposed on a second end of the housing so that the push pole fits snugly within the housing.

4. The motorized push pole device of claim 3, wherein the housing further comprising a handle for a user to grasp and for urging the push pole device to a desired horizontal and vertical plane.

5. The motorized push pole device of claim 4, wherein the electric power supply is a 12-volt direct current power supply.

6. The motorized push pole device of claim 5, wherein the 12-volt direct current power supply is a battery.

7. The motorized push pole device of claim 6, wherein the switch is connected to the motor through a wireless transmitter, a receiver and a controller.

8. A motorized push pole device comprising:

a mounting base for receiving a first section of an elongated standard so that the standard rotates in a horizontal plane, wherein the mounting base is secured to a raised poling platform on a boat;

a housing mounted to a second section of the standard wherein the housing is adapted to removably clamp around a push pole;

a drive wheel interposed between the first section and the second section of the standard, wherein a periphery of the drive wheel is in contact with the push pole and adapted to rotate in a first direction causing the push pole to move in an extendable motion and the drive wheel adapted to rotate in an opposing second direction causing the push pole to move in a retractable motion;

an electrical switch connected to a motor for controlling an operation of the motor for rotating the drive wheel;

an electric power supply for providing electric power to the motor, wherein the motor having a rotating motor shaft terminating in a worm gear; and the drive wheel further comprising a cog wheel for engaging the worm gear of the motor.

9. The motorized push pole device of claim 8, wherein the drive wheel is mounted to an adjustable joint interposed between the first and second sections of the standard so that the housing rotates in a vertical plane to a desired angle.

10. The motorized push pole device of claim 9, wherein the housing further comprising a first half and a second half hingedly connected about a longitudinal edge and having a first aperture disposed on a first end of the housing and a second aperture disposed on a second end of the housing so that the push pole fits snugly within the housing.

11. The motorized push pole device of claim 10, wherein the housing further comprising a handle for a user to grasp and for urging the push pole device to a desired horizontal and vertical plane.

12. The motorized push pole device of claim 11, wherein the electric power supply is a 12-volt direct current power supply.

13. The motorized push pole device of claim 12, wherein the switch is connected to the motor through a wireless transmitter, a receiver and a controller.

14. The motorized push pole device of claim 13, wherein the periphery of the drive wheel is comprised of rubber.

* * * * *